US008286989B2

(12) United States Patent
Wasserman

(10) Patent No.: US 8,286,989 B2
(45) Date of Patent: Oct. 16, 2012

(54) RETRACTABLE BRAKING DEVICE FOR SNOWBOARDS

(76) Inventor: Randall T. Wasserman, San Diego, CA (US)

( * ) Notice: Subject to any disclaimer, the term of this patent is extended or adjusted under 35 U.S.C. 154(b) by 75 days.

(21) Appl. No.: 12/613,840

(22) Filed: Nov. 6, 2009

(65) Prior Publication Data

US 2010/0045000 A1 Feb. 25, 2010

Related U.S. Application Data

(63) Continuation-in-part of application No. 12/105,189, filed on Apr. 17, 2008, which is a continuation-in-part of application No. 11/900,302, filed on Sep. 10, 2007.

(51) Int. Cl.
*A63C 7/00* (2006.01)

(52) U.S. Cl. ..... 280/604; 280/14.22

(58) Field of Classification Search ..... 280/14.21, 280/14.22, 608, 609

See application file for complete search history.

(56) References Cited

U.S. PATENT DOCUMENTS

| | | | | |
|---|---|---|---|---|
| 5,085,455 | A * | 2/1992 | Bogner et al. | 280/618 |
| 6,279,924 | B1 * | 8/2001 | Murphy et al. | 280/14.23 |
| 6,935,640 | B2 * | 8/2005 | Gille et al. | 280/14.28 |
| 2002/0036386 | A1 * | 3/2002 | Murphy et al. | 280/14.23 |
| 2002/0175497 | A1 * | 11/2002 | Freemon | 280/605 |
| 2005/0062240 | A1 * | 3/2005 | Holt | 280/28.11 |

* cited by examiner

*Primary Examiner* — Katy M Ebner

(74) *Attorney, Agent, or Firm* — Nath, Goldberg & Meyer; Jerald L. Meyer

(57) ABSTRACT

A snowboard includes an elongate board member having an upper surface, a bottom surface and a pair of lateral edges. A footbrake is pivotally mounted to the upper surface of the board member by a pivot rod and is pivotable between a raised and undeployed position and a lowered and deployed position. A footbrake retractor attached to the footbrake urges the foot brake toward the raised and undeployed position. A pair of lateral brake paddles are operatively connected to the footbrake and extend beyond the lateral edges of the board member. When the footbrake is in the lowered and deployed position, the pair of lateral brake paddles extend below the bottom surface of the board member. A footbrake conversion kit and method for converting a conventional snowboard into a snowboard with a footbrake are also provided.

8 Claims, 12 Drawing Sheets

RETRACTABLE BRAKING DEVICE FOR SNOWBOARDS

CROSS-REFERENCE TO RELATED APPLICATIONS

This application is a Continuation-In-Part of U.S. application Ser. No. 12/105,189 filed Apr. 17, 2008, which is a Continuation-In-Part of U.S. application Ser. No. 11/900,302 filed Sep. 10, 2007. The contents of both of these prior applications are incorporated herein by reference as if set forth verbatim.

FIELD

The present invention relates generally to devices that allow a user to glide over snow, and more particularly to snowboards. Specifically, the present invention relates to snowboards with braking devices and snowboards with adjustable foot straps.

BACKGROUND

Riders of traditional snowboards are secured to the board by bindings or straps. When the snowboard is pointed directly down the slope with its bottom surface flat on the surface of the snow, it will quickly gather speed. The only way to effectively slow down a traditional snow board is to aim the board across the slope and tilt it so that the edge of the board abrades the surface of the snow. This is a difficult maneuver for a novice snowboarder to perform without falling and risking injury. Thus, a problem with traditional snowboards is that novices must learn to perform turns in order to control their rate of descent. However, turning is a difficult maneuver to master and many novices are injured attempting to turn the snowboard to slow it down.

Another problem with existing snowboards is the necessity of securing the rider's feet to the board with bindings that must be used with large, generally uncomfortable boots. Although bindings and boots are cumbersome, riders of conventional snowboards are forced to use them to perform turns in order to slow down. Furthermore, because the bindings secure both feet to the board, it is difficult to move on a flat surface. To do so, the rider must manually disengage one binding to release a foot in order to push off on the snow, which leaves one foot secured in the binding bent at an uncomfortable, unnatural angle. Thus, a traditional snowboard's requirement of bindings and boots can make snowboarding an unpleasant experience for many snowboarders, particularly novices unaccustomed to using them.

Yet another problem with existing snowboards is that the riders are forced to stand in a fixed, sideways stance. Not only is this stance awkward and uncomfortable, it limits the rider's field of vision. Skiers, by contrast, have a better field of vision because they stand with both feet facing down the hill.

A further problem with traditional snowboards is that they cannot be ridden safely without bindings. As explained above, a rider of a traditional snowboard cannot slow down without performing turns, and turns cannot be performed without bindings. Furthermore, if the rider fell off the snowboard, nothing would prevent it from sliding down the hill without the rider, posing a serious danger to people below. Attempts at solving some of these problems have been made. For example, a braking device for a snowboard is found in U.S. Patent Application Publication No. 2004/0036257. However, the device disclosed therein suffers from at least two disadvantages. First, the position of the brake is fixed and cannot be modulated while the user is riding the snowboard. Second, the brake blade will tend to clog with snow and ice, eventually rendering it ineffective.

Another attempt at providing a braking device for a snowboard-like apparatus is found in U.S. Pat. No. 6,935,640. However, this device is also prone to buildup of snow and ice that hinders operation of the mechanism.

Yet another existing braking device is disclosed in U.S. Pat. No. 6,139,031. This device, however, is operated by an elongated handle mounted in front of the rider. One disadvantage of this device is the danger posed by the handle during a fall. If the rider falls forward, the rider's abdomen, chest, neck, or head is likely to strike the handle, possibly resulting in serious injury.

Accordingly, there is a need for a snowboard with a braking device that is not prone to clogging with snow or ice and that the user can modulate while riding without using a potentially dangerous handle. There is also a need for a snowboard that does not require the use of bindings so that the rider is not limited to a single fixed stance defined by the location of the bindings, or alternatively for a foot attachment system that allows for multiple orientations and positions of the rider's feet. Finally, there is a need for an automatically deployable braking device that would prevent a bindingless snowboard from sliding uncontrollably down the slope without the rider.

SUMMARY

The following presents a simplified summary in order to provide a basic understanding of some aspects of the claimed subject matter. This summary is not an extensive overview, and is not intended to identify key/critical elements or to delineate the scope of the claimed subject matter. Its purpose is to present some concepts in a simplified form as a prelude to the more detailed description that is presented later.

The foregoing needs are met, to a great extent, by the present disclosure. According to one embodiment of the present invention, a snowboard with a retractable braking device is provided. The snowboard includes a board member with a top surface having a riding section. A brake member having solid top, bottom, and lateral surfaces is pivotally collected to the board so that it can pivot through a hole in the riding section of the board member between a retracted position and a deployed position. In one embodiment, the brake member is generally wedge-shaped and the pivotal connection to the board is located on the narrow end of the wedge.

In the retracted position, the bottom surface of the brake is flush with the bottom surface of the board member. In an alternative configuration, the bottom surface of the brake member retracts above the bottom surface of the board member when the braking device is in the retracted position. In the deployed position, the bottom surface of the brake protrudes through the hole and below the bottom surface of the snowboard. In one embodiment, a retractor resiliently holds the brake in the retracted position and provides resistance against inadvertent deployment of the brake. In an exemplary embodiment the retractor is a spring-loaded hinge. Alternatively, it is a tang, torsional spring, or other device capable of resiliently holding the brake in the retracted position. In some embodiments, a brake stop is provided which prevents the brake from retracting beyond the fully retracted position.

According to another embodiment of the present invention, a snowboard with an automatically deployable retractable braking device is provided. This embodiment further includes an automatic brake deployment mechanism operatively connected to a pressure pad which is mounted in the riding section of the board member. When the pressure pad is depressed, the brake deployment mechanism is deactivated. When the pressure pad is released, the brake deployment mechanism is activated and causes the brake to automatically deploy. The pressure pad may be operated by mechanical means and/or may include an electric force transducer. In one embodiment, the automatically deployable braking device further includes a retractor that resiliently holds the brake flush with the bottom surface of the board member when the brake is in the retracted position. Alternatively, this retractor holds the brake above the bottom surface of the board member when the brake is in the retracted position.

In another embodiment of the present invention, a snowboard with automatically deployable retractable braking device further includes a second automatically deployable braking device that is structurally identical to the first braking device, although it may be oriented in the opposite direction as the first braking device. The second braking device is automatically deployable by the brake deployment mechanism in the same way as the first braking device. In an exemplary embodiment, this second braking device includes a second retractor.

The brake deployment mechanism may comprise a first slider slidably attached to the bottom surface of a mechanical pressure pad. The first slider is pivotally connected to two linkages. One linkage is pivotally connected to the board, and the other is pivotally connected to a second slider which is slidably attached to the board. Attached to the second slider is an actuator which releasably engages a cam on the brake when the brake deployment mechanism is activated by a release of pressure on the pressure pad. When the cam and brake are engaged, the brake is essentially locked in the deployed position. The actuator disengages from the cam when the pressure pad is depressed, thus unlocking the brake allowing the rider to manually deploy it as needed.

In any of the above embodiments, as well as in snowboards without braking devices, a foot strap may be attached to the top surface of the snowboard. The foot strap may be adjustable in size. Additionally, the foot strap may be removable or adjustable in position and/or orientation, although in some embodiments it may be fixed in place such that it is not removable or adjustable in position or orientation. The foot strap allows the rider to optionally remain in contact with the top surface of the snowboard during jumps or tricks or other situations when the rider may become separated from the snowboard.

In any of the above embodiments, as well as in snowboards without braking devices, the lateral walls of the board member may be inwardly tapered such that the top surface of the board member is substantially wider than the bottom surface of the board member. At any or all points along the length of the board member, the side walls may be convex such that there is a smooth transition between the side walls and the bottom surface of the board member. Additionally, at any or all points along the length of the board member the side walls may be linear such that the cross-sectional profile is trapezoidal. In such embodiments, metal edges running some or all of the length of the board member may be included at the lower vertices of the trapezoidal cross-section.

In another embodiment of the invention, a snowboard with a wrap-around braking device is provided. The snowboard of this embodiment includes an elongate board member having an upper surface, a bottom surface and a pair of lateral edges. A footbrake is pivotally mounted to the upper surface of the board member by a pivot rod and is pivotable between a raised and undeployed position and a lowered and deployed position. A foot brake retractor is attached to the footbrake and urges the footbrake toward the raised and undeployed position. A pair of lateral brake paddles are operatively connected to the foot brake beyond the lateral edges of the board member and are pivotable about the pivot rod, such that when the footbrake is in the raised and undeployed position, the pair of lateral brake paddles are above the bottom surface of the board member, and when the footbrake is in the lowered and deployed position, the pair of lateral brake paddles are below the bottom surface of the board member. The footbrake retractor may be a compression spring. The snowboard may further include a base plate with a plurality of mounting apertures and a plurality of fasteners passing through the mounting apertures so as to join the base plate to the upper surface of the board member. The plurality of mounting apertures is in a pattern of a conventional rear binding such that the base plate is removable and interchangeable with conventional rear snowboard bindings. The pivot rod may be attached to the base plate. The brake paddles may be elongate high aspect ratio triangular members.

A footbrake conversion kit for snowboards is also provided. The kit includes a base plate with a plurality of mounting apertures, a pivot rod attached to the base plate, a footbrake pivotable about the pivot rod, a footbrake retractor attached to the base plate and to the footbrake, and a pair of lateral brake paddles operatively connected to the footbrake and pivotable about the pivot rod. When the base plate is mounted to a snowboard board member, the footbrake is pivotable between a raised and undeployed position and a lowered and deployed position, and when the footbrake is in the raised and undeployed position, the pair of lateral brake paddles are above the bottom surface of the board member, and when the footbrake is in the lowered and deployed position, the pair of lateral brake paddles are below the bottom surface of the board member. The brake paddles may be elongate high aspect ratio triangular members.

A method of converting a conventional snowboard to a snowboard with a foot brake is also provided. The method includes providing a conventional snowboard with a board member having an upper surface with a rear binding mounted thereto, the upper surface of the board member having a plurality of openings in a pattern for receiving rear binding fasteners. Next, a footbrake conversion kit for snowboards is provided. The kit includes a base plate with a plurality of mounting apertures, a pivot rod attached to the base plate, a footbrake pivotable about the pivot rod, a footbrake retractor attached to the base plate and to the footbrake, and a pair of lateral brake paddles operatively connected to the footbrake and pivotable about the pivot rod. Next, the rear binding is removed from the board member, and then the base plate is placed on the upper surface of the board member in place of the rear binding with the plurality of mounting apertures aligned with the plurality of openings in the upper surface of the board member. Finally, the base plate is mounted to the upper surface of the board member by inserting fasteners through the mounting apertures in the base plate and into the plurality of openings in the upper surface of the board member.

BRIEF DESCRIPTION OF THE DRAWINGS

The present invention will be better understood with a detailed description of some exemplary embodiments of the invention, with reference to the accompanying drawings, in which like reference numerals refer to like parts, and in which.

DETAILED DESCRIPTION

Figure 1:
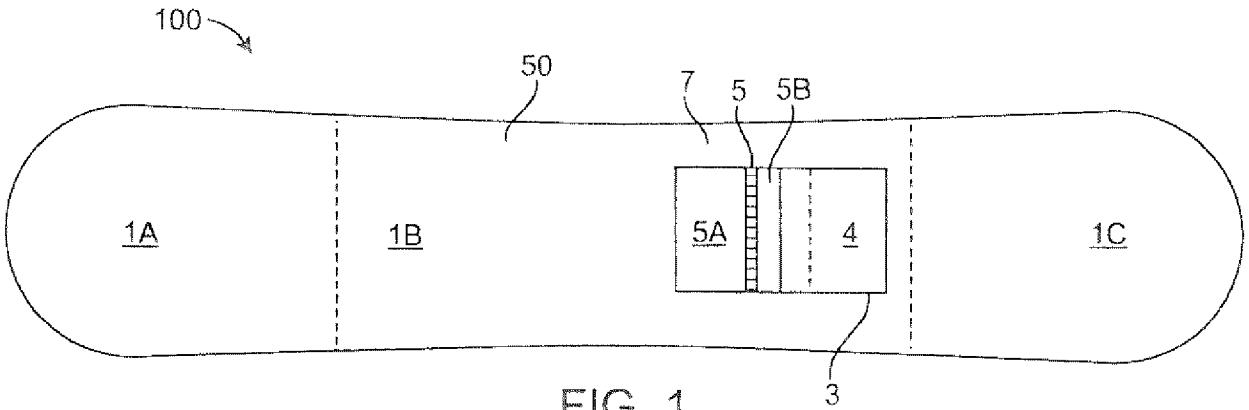
FIG. 1 is a top plan view of a snowboard with retractable braking device, according to a first exemplary embodiment of the present invention.

The present invention provides a retractable braking device for snowboards, as well as a snowboard equipped with a braking device. The braking device is attached to the board member and comprises a brake member that is reversibly pivotal through the board member. All surfaces of the brake member are solid. When the braking device is not activated, the bottom surface of the brake member is in a retracted position, flush with the bottom surface of the board member. As used herein, the bottom surface of the brake member is "flush with" the bottom surface of the board member if the two surfaces are parallel or within ten degrees of being parallel. To activate the braking device and slow down, the rider of the snowboard uses a foot to depress the brake member, which causes the bottom surface of the brake member to extend beyond the bottom surface of the board member into a deployed position. This creates extra drag on the snow, thus slowing the snowboard's rate of descent.

Also provided is an automatically deployable braking device for snowboards. A pressure pad attached to the board member is sensitive to the presence or absence of a rider. If the rider is standing on the pressure pad, the braking device is activatable by the rider. If the rider is not standing on the pressure pad, such as when the rider falls off the snowboard, the pressure pad triggers a brake deployment device which automatically deploys the brake member.

The advantages of the present invention are numerous. First, it allows novice snowboarders to control their rate of descent without performing turns. Furthermore, because a rider of a snowboard equipped with the braking device of the present invention no longer must perform turns to slow down, the need for bindings (which facilitate turning) is eliminated. Thus, another advantage of the present invention is that snowboarders will be able to snowboard without cumbersome bindings and uncomfortable boots. Snowboarders will also be able to perform tricks and maneuvers that are impossible on a board to which they are fixedly secured. Also, snowboarders will be able to stand in any position they desire, not just the sometimes awkward sideways stance required by existing snowboards. For example, a rider of a snowboard equipped with the braking device of the present invention can optionally stand in a more comfortable parallel stance, with both feet pointed toward the front of the board, thus improving the rider's field of vision, or facing in any other direction the rider desires as well. Furthermore, because the rider's feet need not be fixed in place, moving along a flat surface does not require the rider to disengage a binding—the rider can push off with one foot in the snow in a manner similar to a skateboarder riding a skateboard, or simply pick up the board and walk.

The automatically deployable braking device of the present invention allows a rider to modulate the brake member with a foot while riding, and also ensures the board will not slide down the hill if the rider falls. When a rider standing on the pressure pad falls off the board, the pressure pad triggers the brake deployment mechanism which locks the brake member in a deployed position. With the brake member thus deployed, the snowboard will not descend the slope without the rider.

The board member of the snowboard may be identical to those of conventional snowboards. However, it may also be significantly shorter, longer, narrower or wider than those of conventional snowboards, which have effective size constraints because riders must be able to turn and maneuver the boards to slow down. As the present invention provides a braking device for snowboards, the effective size constraints of conventional snowboards are irrelevant—even if the board member is of such a size that it is difficult for the rider execute sharp turns to slow down, the rider can instead use the braking device to slow down.

The sides of the board member may be substantially parallel, but in an exemplary embodiment the middle portion is narrower than the front and rear. The board member also has a hole through it to accommodate a reversibly pivotable brake member. The board member is manufactured using conventional snowboard construction techniques and materials. The top surface of the board member may comprise non-slip material or texture to provide the rider with better traction.

The brake member is reversibly pivotable through a hole in the board member. In order to prevent clogging with ice and snow, every exterior surface of the brake member is solid. The top surface of the brake member may comprise non-slip material or texture to provide the rider with better traction. The bottom of the brake member, or the edge of the brake member opposite the pivoted edge, may be serrated or toothed in order to create more friction between the brake and the snow. The brake member is made from a relatively light and hard material, such as an aluminum alloy, that will not quickly wear down from braking. The brake member may be made from composite materials, or from a combination of plastics, composites, and metals. The brake member and the board member may be made from the same material.

The retractor provides a resilient force that restores the brake member to the fully retracted position when not activated by the rider. In the fully retracted position, the brake member is retracted flush with, or slightly above, the bottom surface of the board member. One end of the retractor is attached to the board member and the other end is attached to the brake member. The force provided by the retractor is generally proportional to the displacement angle of the activated brake member. The retractor may be a spring-loaded hinge with one plate attached to the board member and the other plate attached to the brake member. The hinge may be made from any suitable material, but preferably is made from a strong metal such as steel. The spring is also made from any suitable material, but is preferably made from any metal with a relatively long fatigue life. The retractor may also be a tang with its ends embedded or otherwise attached to the board member and the brake member. The tang is preferably made from any material with a long fatigue life.

To prevent the retractor from over-rotating the brake member beyond the fully retracted position, a brake stop may also be provided. The brake stop may be mounted on the board member or on the brake member itself. Alternatively, the hinge may be designed so that it cannot rotate beyond an angle corresponding to the fully retracted position of the brake. A brake stop mounted on the board member comprises a flange that engages with the brake member (or a flange or protrusion affixed to the brake member) when the brake member reaches the fully retracted position. The engagement of the brake stop and the brake member prevents the brake member from pivoting beyond the retracted position. Any number of brake stop members may be used.

Exemplary embodiments of the invention will now be described in detail below with reference to the appended figures, wherein like elements are referenced with like numerals throughout. The figures are not necessarily drawn to scale and do not necessarily show every detail or structure of the various embodiments of the invention, but rather illustrate exemplary embodiments and mechanical features in order to provide an enabling description of such embodiments. It is to be understood that the scope of the invention shall be defined by the appended claims, not by the specific embodiments described herein.

A first exemplary embodiment of a snowboard with retractable braking device is illustrated in FIG. 1. The snowboard 100 has a board member 50 with top surface 1 and bottom surface 2. The top surface 1 includes front section 1A, riding section 1B, and rear section 1C. The riding section 1B is where the rider stands when riding the snowboard 100. The top surface 1, bottom surface 2, and board member 50 may all be made of the same material, or may be made of different materials integrally formed together. The bottom surface 2 is the gliding surface of the snowboard 100. A hole 3 located entirely within the riding section 1B passes completely through the board member 50, through both the top surface 1 and the bottom surface 2. The hole 3 allows the braking device to interact with the snow upon which the snowboard 100 is gliding.

In this exemplary embodiment, the board member 50 is four feet long, which is significantly shorter than a conventional adult-size snowboard. It is to be understood that the length of the board member 50 is the distance from the end of the nose to the end of the tail. The width of the board member 50 is measured perpendicular to the length and may be measured at any point along the length or the board member 50. Accordingly, it is to be understood that the width of the board member 50 may vary along the length of the board member 50. The top surface 1 of the board member 50 is twelve inches wide at the waist, which is the narrowest portion of the board member. The nose and tail (i.e. front and rear, respectively) of the top surface 1 of the board member 50 are each sixteen inches wide at their widest points. It is to be understood, however, that these dimensions are merely illustrative and in various embodiments the board member may be smaller or larger to accommodate riders of all sizes. This configuration of a narrow waist and wide ends is known as sidecut and it makes the snowboard 100 more maneuverable. The sidecut of the board member 50 is much more pronounced than it is in conventional snowboards that have sidecut. In other words, the waist of the board member is proportionally much narrower than the nose and tail of the board member than is the case in conventional snowboards. The core of the board member 50 is made from fiberglass or epoxy laminated wood, though persons of ordinary skill in the art will recognize that other materials are also suitable. The bottom surface 2 is made from ultra high molecular weight polyethylene (commonly known as p-tex) to provide a smooth gliding surface that can be repaired if deeply scratched. Optionally surrounding the perimeter of the board member 50 are steel edges that provide additional strength and stiffness for the structure. The edges also aid turning if the rider wishes to turn the snowboard 100.

Figure 2:
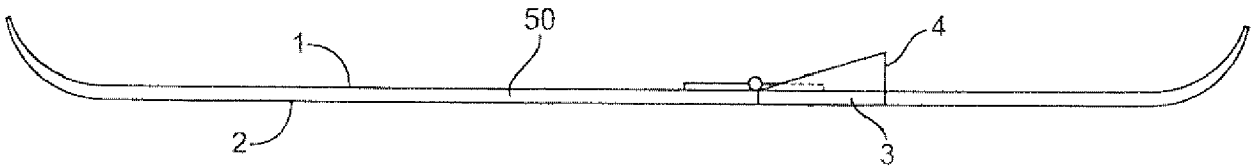
FIG. 2 is a side elevation view of the snowboard of FIG. 1, with the braking device in the retracted position.
Figure 3:
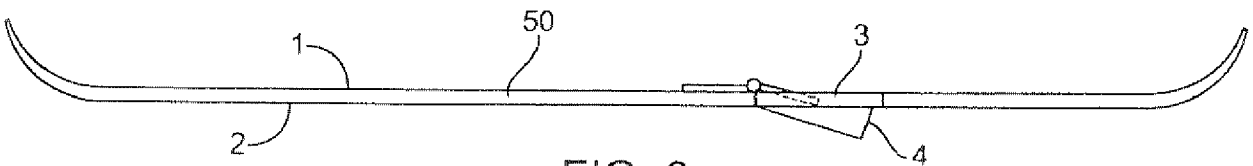
FIG. 3 is a side elevation view of the snowboard of FIG. 1, with the braking device in the deployed position.
Figure 4:
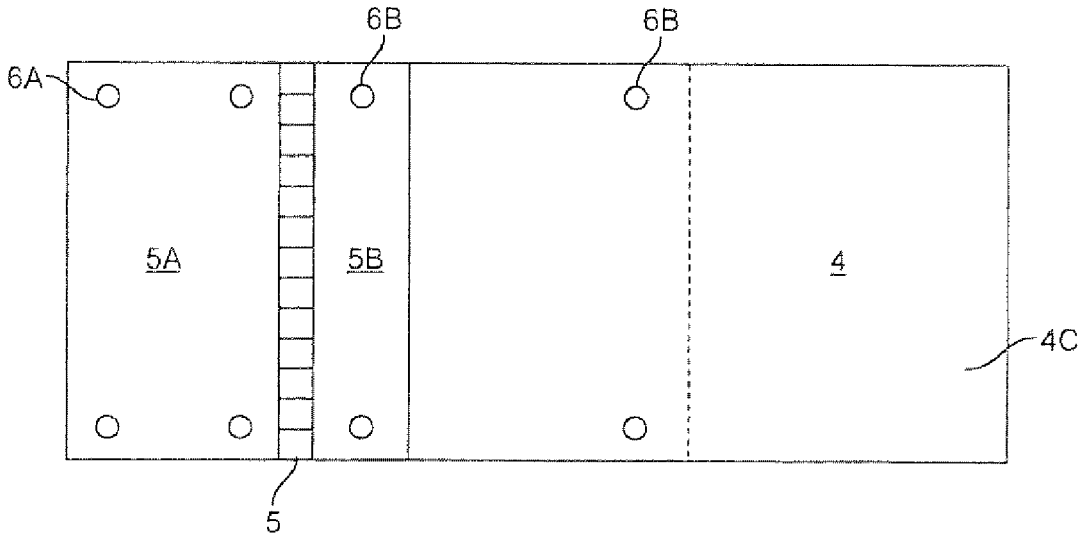
FIG. 4 is a top plan view of the brake and retractor of the braking device of the snowboard of FIG. 1.
Figure 5:
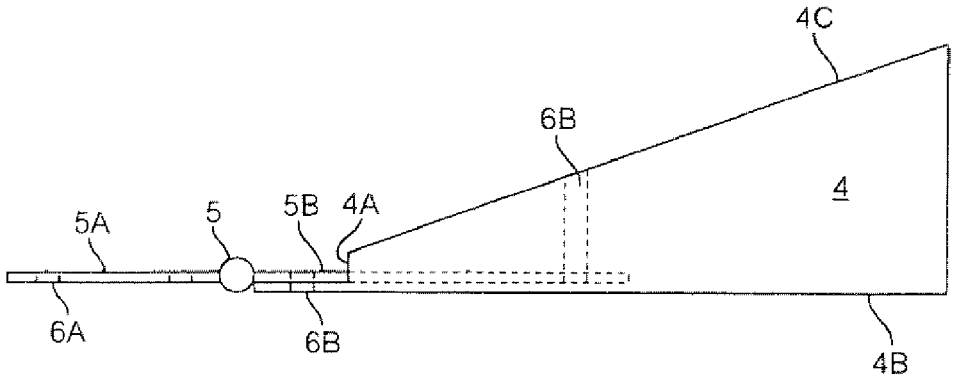
FIG. 5 is a side elevation view of the brake and retractor of FIG. 4.

Still referring to the exemplary embodiment illustrated in FIG. 1, the braking device includes a generally wedge-shaped brake member 4 that is pivotally connected to the board member 50. The brake 4 is completely solid, though in an alternative embodiment it is hollow with solid exterior surfaces. The narrow end 4A of the wedge is the front end of the brake 4 and is pivotally connected to the board member 50 within the riding section 1B adjacent to the front edge of the hole 3. Included in the pivotal connection is a retractor which, in this embodiment, is a spring-loaded hinge 5 with a front hinge plate 5A fixedly attached to the board member 50 within the riding section 1A, and a rear hinge plate 5B fixedly embedded in the front end 4A of the brake 4. The spring-loaded hinge 5 resiliently holds the brake 4 in a retracted position, as shown in FIG. 2. As shown in FIG. 3, when the rider applies sufficient force to the top surface of the brake 4C to overcome the resistance provided by the spring-loaded hinge 5, the rear hinge plate 5B rotates clockwise and the brake 4 pivots through the hole 3 into a deployed position.

To increase the strength of the attachment between the hinge 5 and the board member 50, mounting screws 6 are provided. Mounting screws 6A pass through the top surface 1 into the board member 50, and through the front hinge plate 5A, but do not pass though the bottom surface 2. Similar mounting screws 6B secure the rear hinge plate 5B to the end 4A of the brake 4. The mounting screws 61B pass through the holes in the rear hinge plate 5B and into the brake 4, but do not penetrate the bottom surface 4B of the brake 4. Adhesives are optionally used to further increase the strength of the attachment of the hinge plates.

In alternative embodiments, the front hinge plate 5A is fixedly attached to the top surface 1 or to the bottom surface 2. Also alternatively, the rear hinge plate 5B is fixedly attached to the top surface 4C or the bottom surface 4B of the brake 4. In another alternative embodiment, the plates of the hinge 5 are embedded in the board member 50 and the brake 4, and mounting screws mayor may not be used. Persons of ordinary skill will recognize that other fasteners and attachment means may be used without departing from the scope and spirit of the invention.

The riding section 1B of the board member 50 and the top surface 4C of the brake 4 may have a non-slip surface to increase rider safety. The trailing edge of the bottom surface 4B of the brake 4 may be serrated to provide better bite with the snow when the brake is actuated by the rider. The depth of these serrations may be anywhere from a fraction of an inch to several inches, and in alternative embodiments there may be no serrations. In general, the deeper the serrations are, the more bite the brake has with the snow when the brake is actuated. Optionally, the bottom surface 4B (as opposed to the trailing edge of the bottom surface 4B) of the brake 4 may itself have serrations. Depending on the size of the rider, the size of the brake 4 varies. However, for an average size person, the brake 4 is approximately six inches wide by eight inches long by four inches tall. In alternative embodiments the brake 4 may be as little as one-half inch wide or as much as approximately 80% of the width of the board member 50 at its waist.

The hole 3 and brake 4 are dimensioned such that the brake 4 is large enough that the rider can easily locate the brake 4 by feel, yet small enough that the board member 50 retains its structural integrity. If the hole 3 is too wide, the board will flex too much and possibly break in the vicinity of the hole 3. The brake 4 is slightly smaller than the hole 3 so that it can pivot through the hole 3 without scraping the edges. However, the brake 4 must not be too much smaller than the hole 3 in order to ensure that snow and ice do not build up on the edges of the hole 3. For example, in this exemplary embodiment, the hole 3 is approximately $1/16^{th}$ of an inch longer and wider than the brake 4. The offset 7 of the hole 3 from the edge of the board member 50 should be at least two inches in order to maintain structural integrity. In this embodiment, the offset 7 on each side of the hole 3 is four inches.

In this exemplary embodiment, the spring-loaded hinge 5 is made of steel. Depending on the weight of the intended rider, the spring constant of the spring-loaded hinge 5 varies. For example, in a braking device designed for a child's snowboard, the spring constant would be much smaller than if the braking device were designed for all adult's snowboard. The resilient force provided by the spring-loaded hinge 5 is approximately proportional to the angle through which the brake 4 rotates. Accordingly, small deflections of the brake 4 require the rider to apply a relatively small force, while large deflections require a proportionally larger force. Additionally, when the brake 4 is actuated and begins to penetrate the surface of the snow, the snow itself augments resistance to further deflection of the brake 4.

Figure 6:
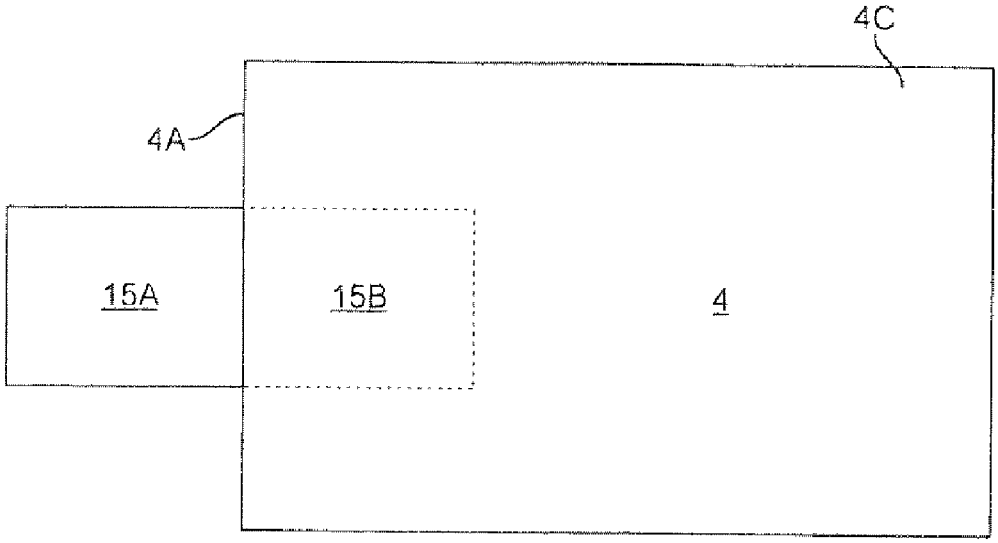
FIG. 6 is a top plan view of the brake and retractor of the braking device according to another embodiment of the invention.
Figure 7:
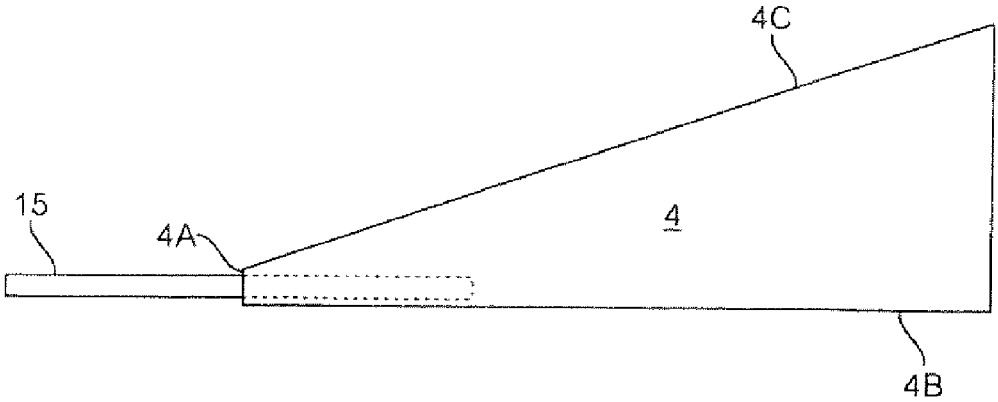
FIG. 7 is a side elevation view of the brake and retractor of FIG. 6.

A braking device according to an alternative embodiment of the present invention is illustrated in FIGS. 6 and 7. Instead of a spring-loaded hinge 5, the retractor comprises a flexible tang IS. The front end 15A of the tang 15 is fixedly embedded within the board member 50 while the rear end 15B is fixedly embedded in the thinner end 4A of the brake 4. A dowel pin is used to better secure the embedded ends of the tang 15. Similar to the attachment of the hinge 5, mounting screws 6 are optionally used to increase the strength of the attachment between the tang 15, the board member 50, and the brake 4.

Figure 8:
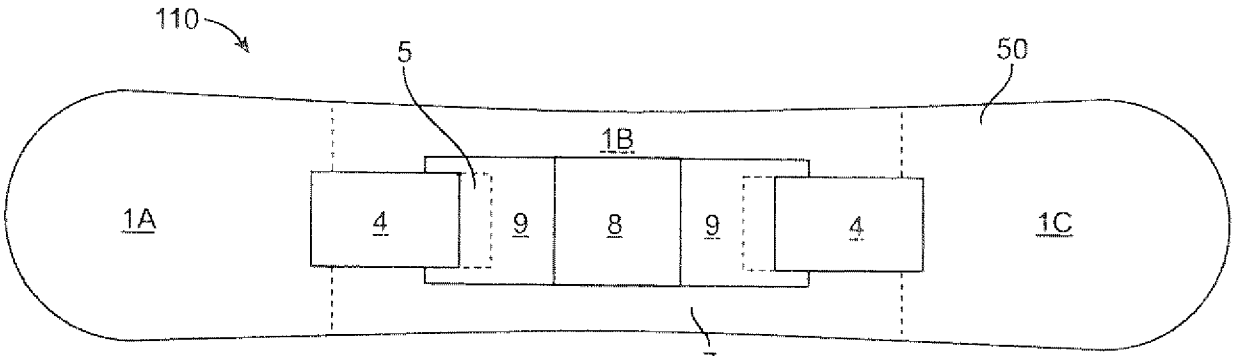
FIG. 8 is a top plan view of a snowboard with automatically deployable braking devices, according to a second exemplary embodiment of the present invention.
Figure 9:
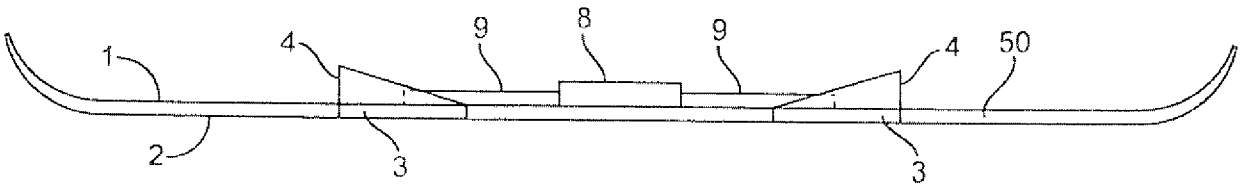
FIG. 9 is a side elevation view of the snowboard of FIG. 8, with the braking devices in the retracted position.
Figure 10:
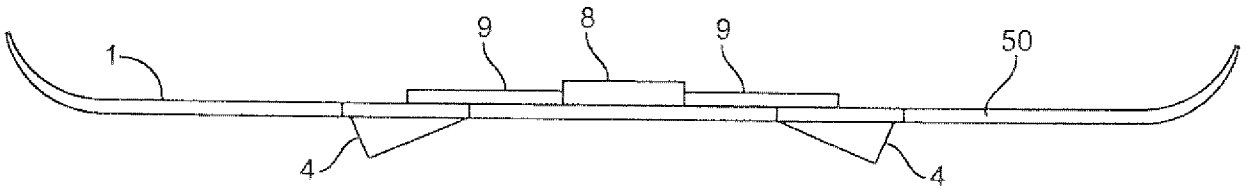
FIG. 10 is a side elevation view of the snowboard of FIG. 8, with the braking devices in the deployed position.
Figure 12:
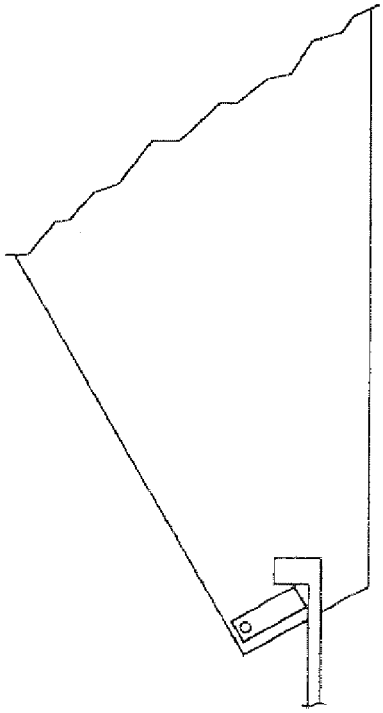
FIG. 12 is a partial side elevation view of the brake deployment mechanism of FIG. 11, showing the braking device in the retracted position.
Figure 11:
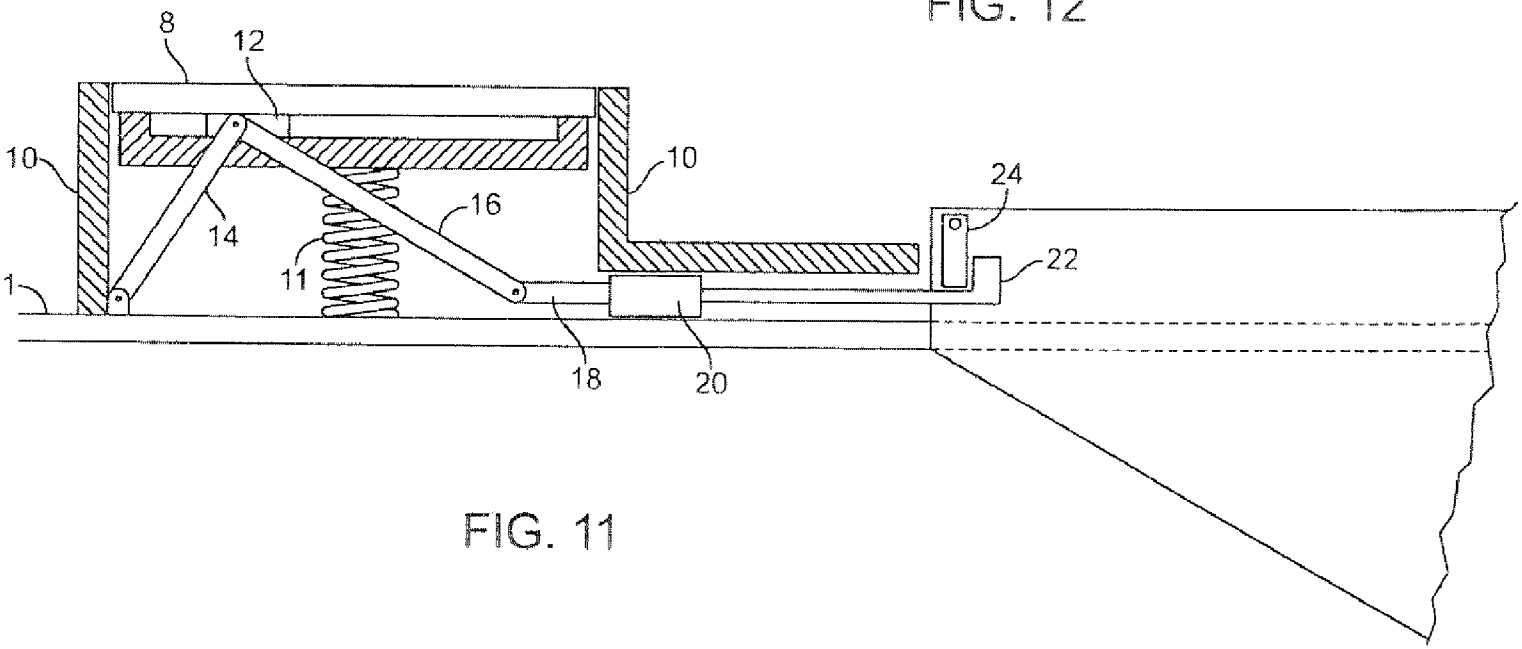
FIG. 11 is a side elevation cut-away view of the brake deployment mechanism of the snowboard of FIG. 8, showing the braking device in the deployed position.

As seen in FIG. 8, a snowboard 110 with an automatically deployable braking device is provided in a second exemplary embodiment of the present invention. Similar to the first exemplary embodiment, the braking device comprises a solid, wedge-shaped brake 4 with embedded spring-loaded hinge 5 that resiliently holds the brake 4 in the retracted position. However, in this embodiment, the hole 3 and brake 4 may be in any section of the top surface 1 of the board member 50. The snowboard 10 further comprises a pressure pad 8 mounted in the riding section 1B and a brake deployment mechanism 9 operatively connected to the pressure pad.

The brake deployment mechanism 9 includes a spring 11 with one end fixedly attached to the bottom of the pressure pad 8 and with the other end fixedly attached to the board member 50. The brake deployment mechanism 9 is contained in a housing 10, which both protects the mechanism from snow and ice and constrains movement of the pressure pad 8 to a path that is generally perpendicular to the plane of the top surface 1. The housing 10 is made from a strong material with low friction coating. In this embodiment, the housing is made from polytetrafluoroethylene coated aluminum.

A mechanical linkage allows for automatic deployment of the brake 4 when the pressure pad 8 is in the raised position. The first member 14 of the mechanical linkage has a first end pivotally connected to the board member 50. The second end of the member 14 is pivotally connected to a first slider 12 which is slidably mounted to the bottom of the pressure pad 8. Also pivotally connected to the first slider 12 is the first end of the second member 16 of the mechanical linkage. The second end of the second member 16 is pivotally connected to an extension 18 of a second slider 20. The extension 18 is fixedly attached to the second slider 20. Also fixedly attached to the second slider 20 is an actuator 22. The actuator 22 extends past the pivoted end of the brake 4. A cam 24 is fixedly attached to the lateral surface of the brake 4. The linkage members, the actuator, and the cam are made of steel.

When the pressure pad 8 is depressed by the rider, the first member 14 is forced to rotate clockwise, thus pushing the first slider 12 to slide toward the brake 4. As the pressure pad 8 moves downwardly and the first slider 12 moves toward the brake 4, the second member 16 is forced to simultaneously rotate counterclockwise and translate toward the brake 4. This translation of the second member 16 causes the extension 18 to also translate toward the brake 4. Because the extension 18 is fixedly attached to the second slider 20, the second slider 20 also translates toward the brake 4. The translation of the second slider 20 causes the actuator 22 to disengage from the cam 24. As the actuator 22 and the cam 24 disengage, the spring-loaded hinge 15 causes the brake 4 to rotate counterclockwise until it reaches the retracted position.

When the pressure pad 8 is in the lowered position and the brake 4 is thus in the retracted position, the actuator 22 has no effect on the brake 4 or the spring-loaded hinge 5, and the rider can modulate the brake 4. However, when the rider steps (or falls) off the pressure pad 8, the spring 11 will force the pressure pad 8 away from the top surface 1, thus engaging the actuator 22 with the cam 24. As the pressure pad 8 rises, the actuator 22 pulls on the cam 24 with sufficient force to overcome the resistance of the spring-loaded hinge 5. This causes the brake 4 to rotate clockwise into the deployed position. The engagement of the actuator 22 with the cam 24 essentially locks the brake 4 in the deployed position because the brake 4 can only rotate counterclockwise if the resistance provided by the spring 11 is overcome.

The spring constant of the spring 11 is much greater than the spring constant of the spring-loaded hinge 5. The ratio of these spring constants helps define the critical pressure required to hold the pressure pad in the depressed position. The higher the ratio of the spring constant of the spring 11 to that of the spring-loaded hinge 5, the greater the critical pressure required to keep the pressure pad depressed. In an exemplary embodiment designed for a rider of average size, the ratio of these spring constants is at least 3 to 1.

In some embodiments, the automatically deployable retractable braking device may incorporate two brake members 4, one behind the rider and one in front of the rider. The pivotal connections between the brake members 4 and the board member 50 are on the edges of the brake members 4 closest to the middle of the board member 50. In these embodiments, the brake deployment mechanism 9 is operatively connected to both brake members 4, such that both brake members deploy and retract simultaneously.

Figure 13:
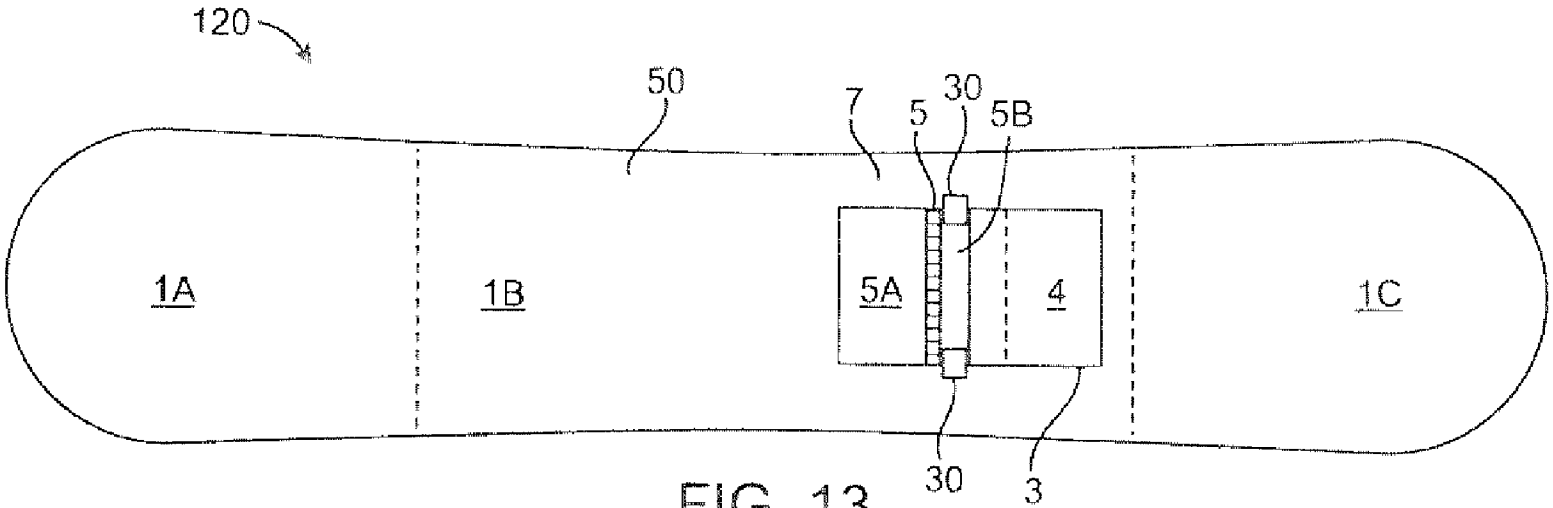
FIG. 13 is a top plan view of a snowboard with retractable braking device, according to another embodiment of the present invention.
Figure 14:
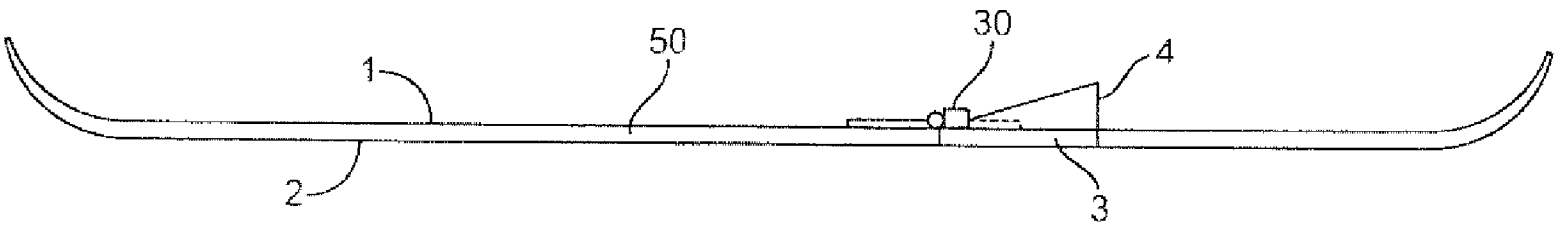
FIG. 14 is a side elevation view of the snowboard of FIG. 13.

In any of the foregoing embodiments, a brake stop 30 may be provided to prevent the retractor from causing the brake 4 to retract beyond the fully retracted position. As best seen in FIGS. 13 and 14, a snowboard 120 has two brake stops 30 affixed to the top surface 1 of the board member 50. The brake stops 30 are, in this embodiment, steel flanges affixed to top surface 1 adjacent to the sides of hole 3. In the illustrated embodiment, the brake stops 30 engage with the rear hinge plate 5B. Engagement occurs only when the brake 4 is in the fully retracted position, thus preventing it from pivoting any further. Alternatively, there may be any number of brake stops 30 at various locations on the top surface 1 adjacent to the hole 3, engaging with the hinge 5, the brake 4, a flange affixed thereto, or any combination of the preceding. Also alternatively, a flange affixed to the brake 4 may engage with the board member to prevent over-rotation. Also alternatively, the hinge 5 may be a stop hinge such that the moveable hinge plate 5B cannot rotate beyond an angle corresponding to the fully retracted position of the brake 4.

Figure 15:
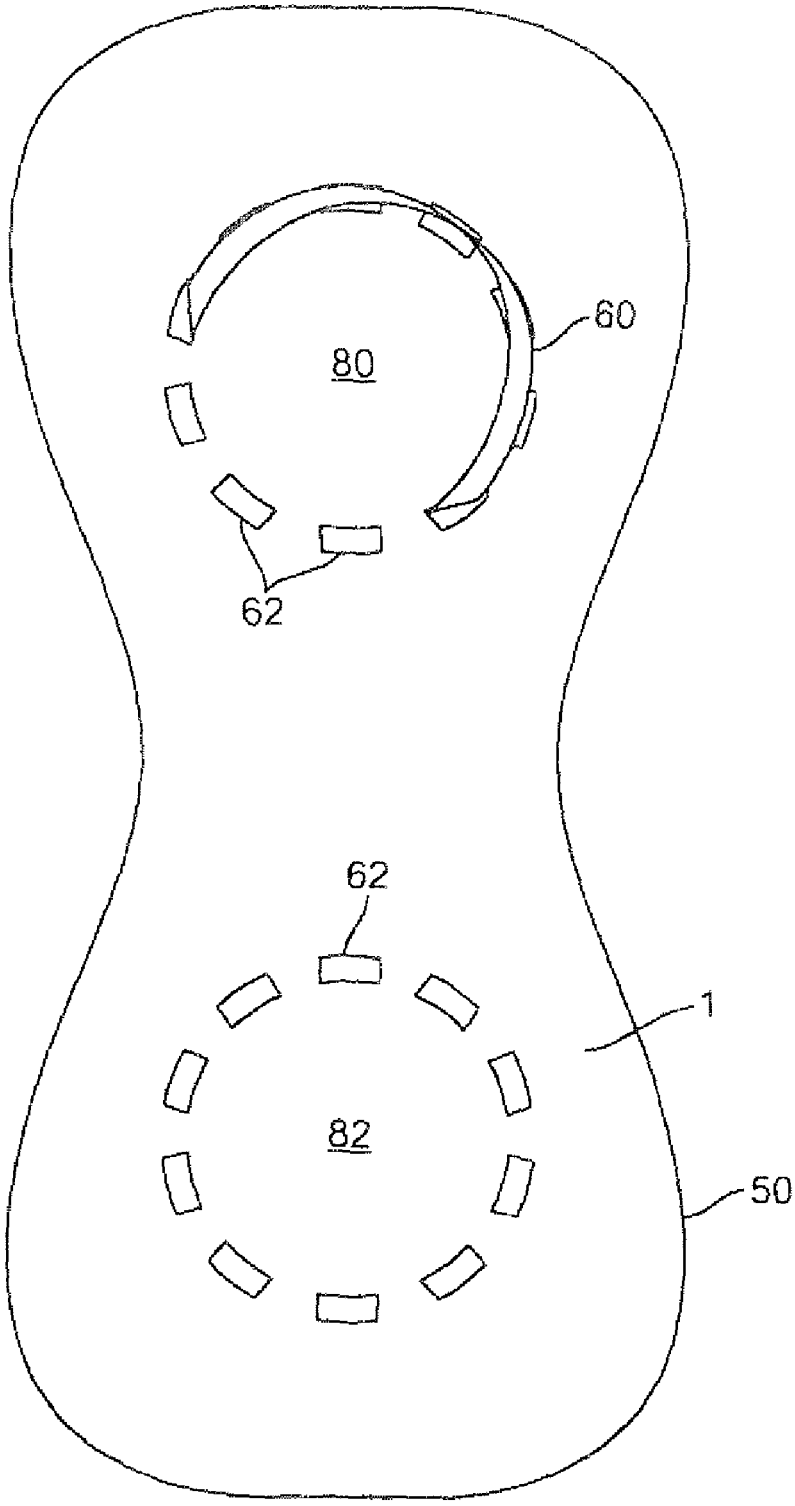
FIG. 15 is a top plan view of a snowboard with strap mounts on the top surface of the board member, wherein an attachable foot strap is adjustable in position and orientation.

In any of the foregoing embodiments, one or more foot straps 60 may be attached to the top surface 1 of the board member 50, as shown in FIG. 15. As used herein, a "foot strap" is a band having at least two ends, wherein each end is attached to the top surface of the board member 50 to form a loop into which a rider inserts his or her feet. It is to be understood that two or more such bands may be joined together (such as by hook and loop, buckles, interlocking loops, etc.) to form foot strap 60. Preferably, foot strap 60 is attached to the riding section 1B of the top surface 1. Foot strap 60 may be fixedly attached to the top surface 1, such as where the ends of the foot strap 60 are embedded in or adhered to the top surface 1. However, foot strap 60 is preferably removably attached to the top surface 1 using strap mounts 62. As used herein, "strap mounts" include any device or mechanism by which foot strap 60 may be releasably attached to the top surface 1. Strap mount 62 may attach directly to foot strap 60, or may be a releasably engageable fastener that attaches to a complementary fastener on foot strap 60. Strap mounts 62 include without limitation hook and loop, male and female buckles, snaps, buttons, interlocking bands and rings, and the like.

Figure 16A:
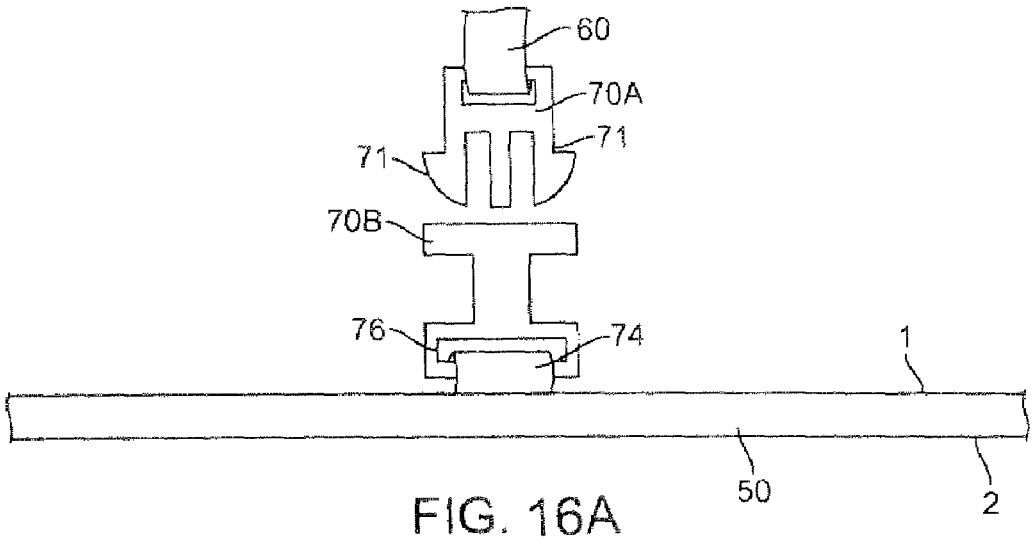
FIG. 16A shows a pair of complementary plastic buckles suitable for releasable attachment of a foot strap to the top surface of the board member.

In one embodiment, strap mounts 62 are releasably engageable plastic buckles 70A and 70B that snap together when engaged. As shown in FIG. 16A, one buckle 70A or 70B is attached to each end of the strap, while complementary buckles (70B and 70A, respectively) are attached to the top surface 1. The rider attaches foot strap 60 by inserting buckle 70A into buckle 70B, thus engaging the buckles 70. The rider releases foot strap 60 by depressing the sides 71 of buckle 70A to disengage the buckles. It is to be understood that many other types of buckles may be used, and that it makes no difference which of the complementary buckles is attached to foot strap 60 or to top surface 1. The buckles 70 are attached to the top surface 1 by any suitable means, including fabric loops 84 which pass through buckle rings 76 and are embedded, adhered, riveted, or otherwise affixed (either removably or permanently) to top surface 1.

Figure 16B:
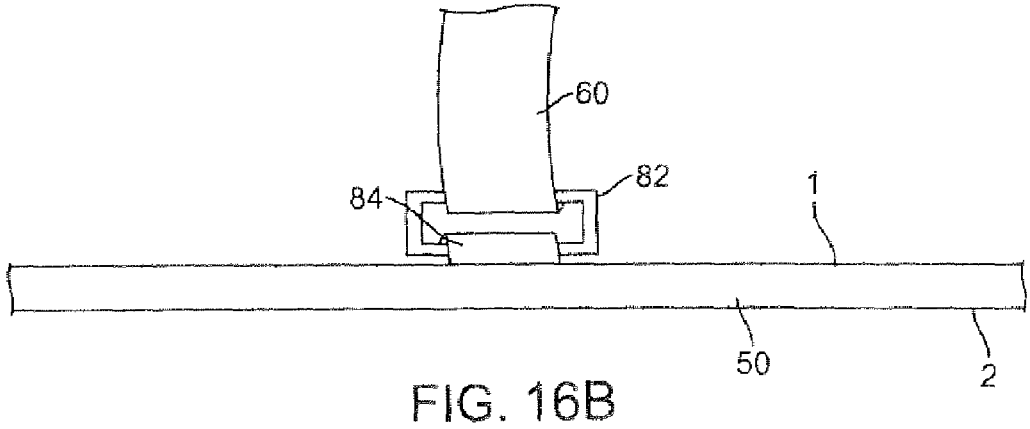
FIG. 16B shows a ring attached to the top surface of the board member for releasable attachment of a foot strap.

In another embodiment, shown in FIG. 16B, strap mounts 62 are plastic or metal rings 82 attached to the top surface 1. The rings 82 are attached to the top surface 1 by any suitable means, including fabric loops 84 which pass through the rings 82 and are embedded, adhered, riveted, or otherwise secured to top surface 1. An end of foot strap 60 is attached to the ring by threading it through ring 82 to form a loop around ring 82. This loop is made secure by, for example, a fastener which joins two portions of foot strap 60 together to prevent foot strap 60 from pulling through ring 82. Such a fastener may be, without limitation, hook and loop. The foot strap 60 may be looped securely around ring 82 by any suitable method.

In embodiments with foot straps that are adjustable in orientation, multiple strap mounts 62 are attached to the top surface 1 in a variety of locations near a first foot position 80, as shown in FIG. 15. By placing strap mounts 62 in a generally circular configuration about first position 80, foot strap 60 may be attached in a variety of orientations, as shown in FIG. 15. This adjustability in orientation allows the rider to use the foot strap 60 while facing in any direction. Although a circular distribution of strap mounts 62 is illustrated and is preferred, it is to be understood that any other distribution may also be used.

In embodiments with foot straps that are adjustable in position, additional strap mounts 62 are attached to the top surface 1 near a second foot position 82 spaced apart from first foot position 80, as shown in FIG. 15. By placing strap mounts 62 at both first foot position 80 and second foot position 82, foot strap 60 is made adjustable in position by detaching it from first position 80 and attaching it at second position 82. Alternatively, two foot straps 60 may be attached, one at first position 80 and the other at second position 82. Additional foot straps 60 may be added in like manner by providing strap mounts 62 at additional foot positions on the top surface 1.

Foot strap 60 is preferably adjustable in size according to known methods. For example, foot strap 60 may comprise two straps that are joined together in an adjustable manner, such as by hook and loop fasteners or buckles that provide strap length adjustment. By making foot strap 60 adjustable, the rider can choose to be firmly attached to the board member 50 by making foot strap 60 tight. Alternatively, the rider can choose to make foot strap 60 loose such that the rider can easily remove his or her foot from foot strap 60.

The use of foot straps aids the rider in remaining in contact with the board member 50 when performing jumps or tricks where the rider tends to become separated from the board member 50. For example, foot straps 60 aid the rider in performing "ollies" in which the rider jumps off the ground with the board member 50 still in contact with the rider's feet in mid-air. Foot straps 60 also aid the rider in performing skateboard-style tricks such as slides or grinds along obstacles such as logs or rails.

Figure 17:
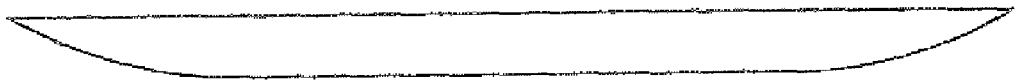
FIG. 17 is a cross-sectional profile of a board member with inwardly tapered, curved side walls.
Figure 18:
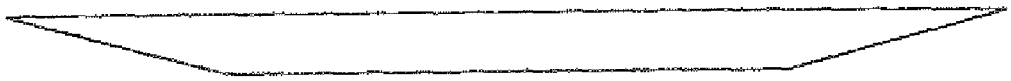
FIG. 18 is a cross-sectional profile of a board member with inwardly tapered, straight side walls, with optional metal edges shown at the vertex between the side walls and the bottom surface of the board member.

In any of the foregoing embodiments, the board member 50 may have inwardly tapered side walls at any or all points along its length such that the top surface 1 is substantially wider than the flat portion of the bottom surface 2, as shown in FIGS. 17 and 18. For example, at a given point along the length of the board member 50, the top surface 1 may be four inches wider than the bottom surface 2 (i.e. two inches wider along each side). This difference in width makes it easier for the snowboard to rock from side to side as the rider shifts his or her weight in order to turn. This board member geometry is particularly advantageous in embodiments where the board member does not have any foot attachment system. In such snowboards, this geometry makes it easier for the rider to rock the snowboard to one side without using a foot attachment system to help pull one side of the board member upward. Thus, this unique geometry helps overcome a challenge of riding a snowboard without a foot attachment system.

FIG. 17 shows a cross-sectional profile view of a board member with inwardly tapered, convex curved side walls 40 that smoothly blend into the flat bottom surface 2. This cross-sectional profile may be constant along the entire length of the board member 50, or it may blend to a more traditional substantially rectangular profile at various locations along the length of the board member 50. Because the curved side walls 40 smoothly blend into the bottom surface 2, there is not a vertex (i.e. corner) between the side walls 40 and the bottom surface 2. In conventional snowboards, there is a vertex between the side walls and the bottom surface, and along this vertex there is generally a sharp steel edge. In the embodiment of FIG. 17, by contrast, there is no vertex at all and hence no sharp steel edge.

FIG. 18 shows a cross-sectional profile view of a board member with inwardly tapered, straight side walls 42 that meet the bottom surface 2 at vertices 44. Hence, the cross-sectional profile has a trapezoidal shape. This cross-sectional profile may be constant along the entire length of the board member 50, it may blend to the cross-sectional profile of FIG. 17, and/or it may blend to a more traditional substantially rectangular profile at various points along the length of the board member 50. Sharp steel edges 46 are optionally incorporated along the vertices 44, and these steel edges may run the entire length of the board member 50 or only for a partial segment of the length. These steel edges 46 serve at least three purposes. First, they provide additional structural rigidity for the board member 50. Second, they help protect the vertices between the side walls 42 and the bottom 2 from being damaged or gouged by rocks. Third, they provide bite with the snow when the board member 50 is tilted over by the rider while performing a turn.

Figure 19:
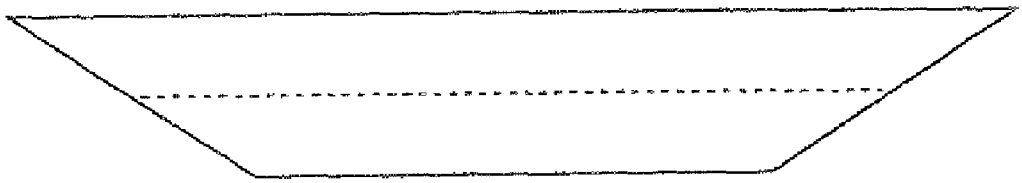
FIG. 19 shows a comparison between similar cross-sectional profiles of board members with different thicknesses.

The difference in width between the top surface 1 and the bottom surface 2 in the embodiments of FIGS. 17 and 18 may be even more pronounced if the board member 50 is thicker than the conventional snowboards. As shown in FIG. 19, the additional thickness allows for the side walls 40 or 42 taper inward further than is possible with a board member 50 having a conventional thickness (indicated by the dashed line if FIG. 19). The riding geometry created by the cross-sectional profiles of FIGS. 17 and 18 allows for greater ease of turning whether or not the rider is using a foot strap 60. This unique riding geometry is exaggerated by using a relatively thick board member 50.

Other types of retractable braking devices are also contemplated. For example, the brake does not necessarily pass through an opening in the board member. Instead, for example, braking members may extend past the lateral edges of the board member such that they pivot around the board member rather than passing through it. A braking device with braking members that pivot around the board member rather than pivoting through an opening the board member is hereinafter referred to as a "wrap-around" braking device. One significant advantage of a wrap-around braking device is that, in some embodiments, it may be retrofitted onto an existing traditional snowboard, for example as part of a snowboard foot brake conversion kit. However, it is to be understood that a wrap-around braking device may also be incorporated into new snowboards specifically designed for such a braking device.

Figure 20:
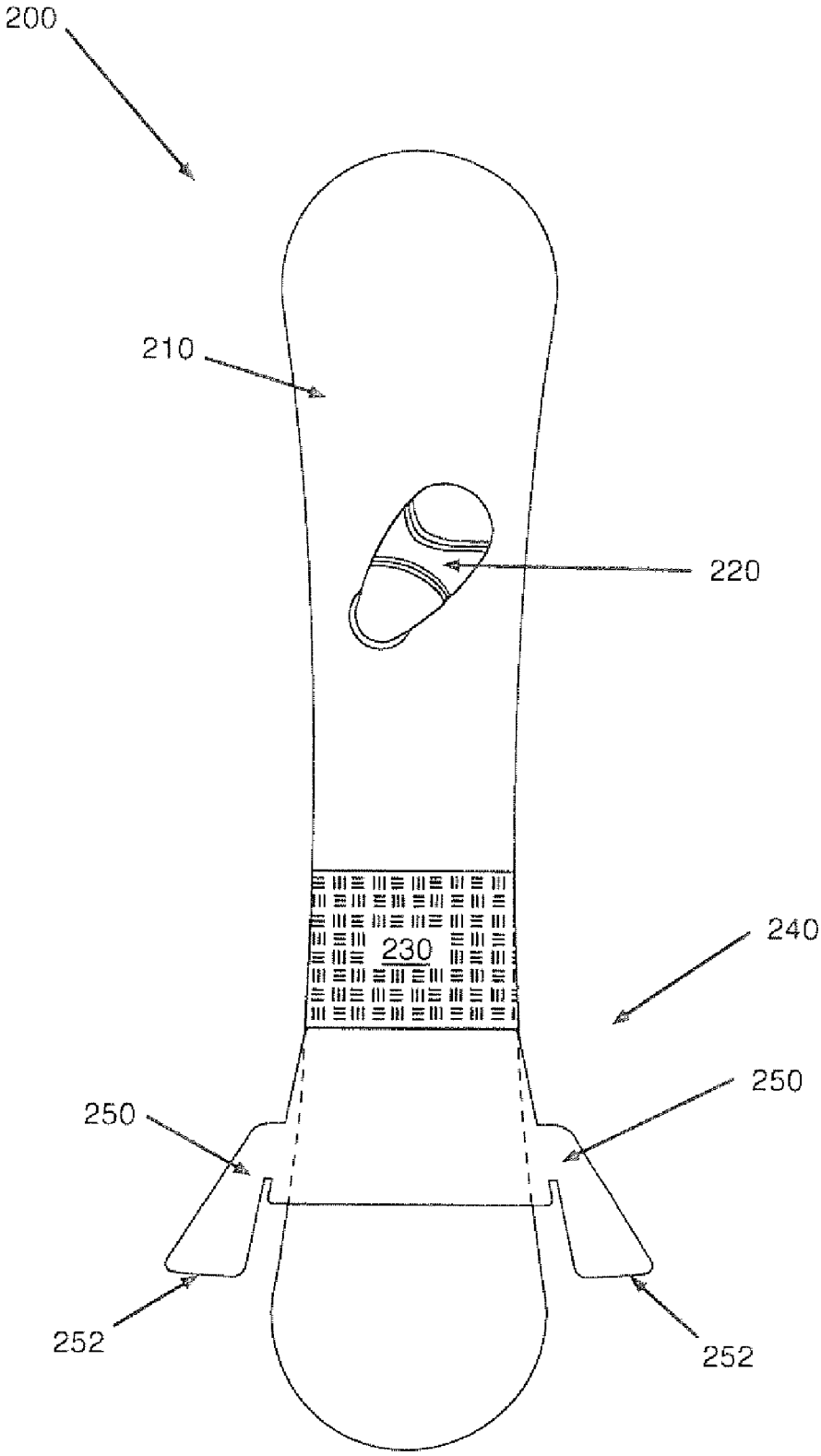
FIG. 20 shows a top plan view of a snowboard with wrap-around braking device.

FIG. 20 shows a snowboard 200 with wrap-around braking device 240. As explained above, the snowboard 200 may be comprised of a conventional board member 210 that is retrofitted with wrap-around braking device 240, or it may be specifically designed to incorporate wrap-around braking device 240. Snowboard 200 may have front binding 220 mounted to the upper surface of board member 210. Front binding 210 may be a conventional snowboard binding known in the art, or any type of foot strap (including foot straps adjustable in position and orientation) as previously disclosed. Wrap-around braking device 240 is mounted to board member 210 at approximately the location where a rider's rear foot would be placed while riding a conventional snowboard.

Figure 21:
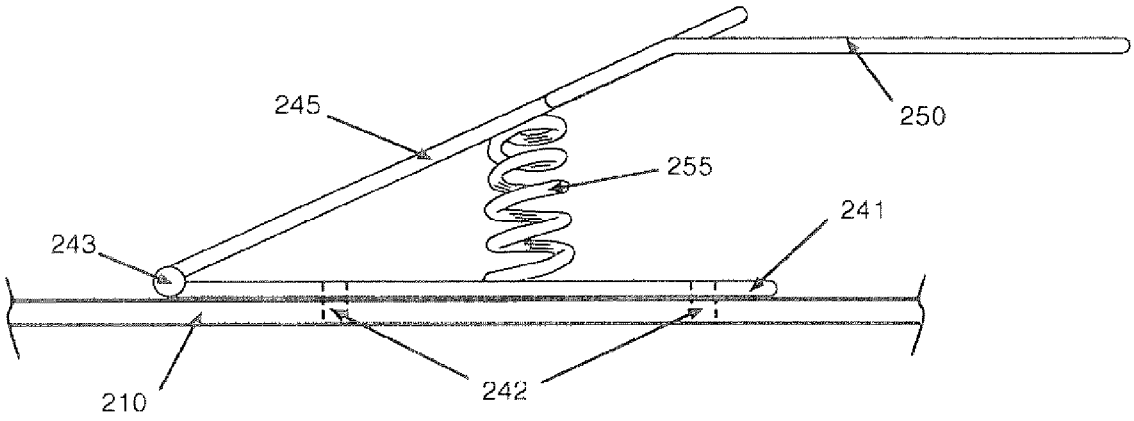
FIG. 21 shows a side profile view of a wrap-around braking device.

In an exemplary embodiment of a foot brake conversion kit for conventional snowboards, wrap-around braking device 240 includes base plate 241. As shown in FIG. 21, base plate 241 has mounting apertures 242 arranged in a pattern to match the mounting holes made in a conventional board member when the rear binding was originally mounted. Thus, base plate 241 is mounted in the same location as a previously removed rear binding, using the existing mounting holes in board member 210. This has the advantage that, in some embodiments, the wrap-around braking device 240 can be interchanged with a conventional rear binding, making the snowboard more versatile. Base plate 241 is made of a strong rigid material, preferably metal such as aluminum or steel, but may also may be made from a composite laminated material such as those used in conventional board member cores, as discussed above.

Base plate 241 serves as the foundation and attachment point for wrap-around breaking device 240. As shown in FIGS. 20 and 21, wrap-around braking device 240 includes footbrake 245. Footbrake 245 can take a variety of forms, but in this embodiment it is essentially a flat plate member pivotally attached to base plate 241 adjacent the front end of base plate 241 via pivot rod 243. Footbrake 245 is operatively connected to a pair of lateral brake paddles 250 which are the parts of wrap-around braking device 240 which actually interact with the snow when the braking device is activated by the rider depressing footbrake 245. As best seen in FIG. 21, brake paddles 250 are operatively connected to footbrake 245 at an angle so that brake paddles 250 contact the snow before footbrake 245 reaches the lower terminus of its range of motion.

Footbrake 245 and operatively connected brake paddles 250 are maintained in a raised, undeployed position by a footbrake retractor. In this embodiment, the footbrake retractor is a compression spring 255 mounted between base plate 241 and footbrake 245 such that when footbrake 245 is depressed, compression spring 255 is compressed and therefore provides an opposing force which resists further depression of footbrake 245 and urges footbrake 245 toward the raised, undeployed position. Other types of foot brake retractors are also contemplated. For example, the footbrake retractor may also be a torsion spring mounted about pivot rod 243 and affixed to base plate 241 and footbrake 245 such that when footbrake 245 is depressed, the torsion spring is twisted such that it resists further depression of footbrake 245 and urges footbrake 245 back to the raised, undeployed position.

Brake paddles 250 and footbrake 245 may be operatively connected to one another in any number of ways. For example, in one embodiment, brake paddles 250 are operatively connected to footbrake 245 using fasteners such as screws or bolts. However, in an exemplary embodiment, brake paddles 250 and footbrake 245 are integrally molded as a single piece. This is particularly advantageous when wrap-around braking device 240 is part of a footbrake conversion kit as the one-piece construction simplifies installation and strengthens the structural integrity of the connection between brake paddles 250 and footbrake 245.

Figure 22:
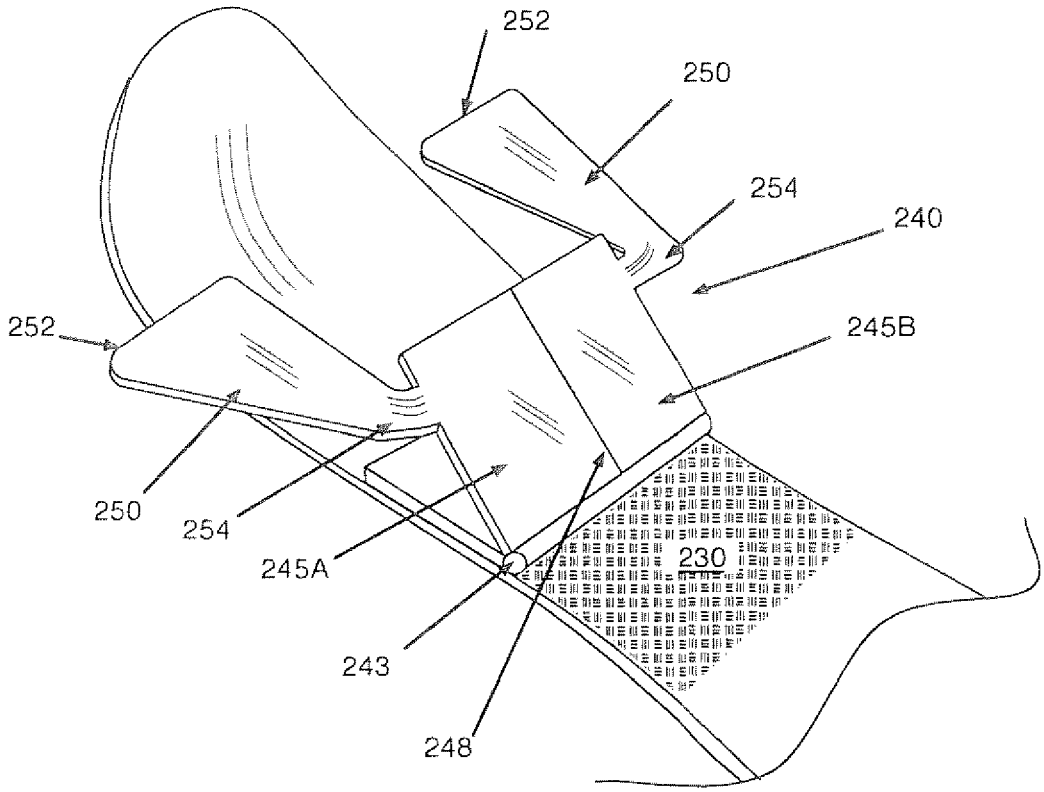
FIG. 22 shows a perspective view of a wrap-around braking device with integral brake paddles and footbrake.

Brake paddles 250 may take a wide variety of forms, but are generally elongate planar members configured for fixed (or integral) attachment to footbrake 245. For example, as best shown in FIGS. 20 and 22, each brake paddle 250 may be a relatively high aspect ratio triangular member with the base of the triangle being at rear end 252 of brake paddle 250 and with the apex of the triangle at front end 254 of brake paddle 250. Thus, viewed from above, brake paddles 250 in this embodiment resemble a "delta wing" configuration on an airplane, with rear ends 252 of brake paddles 250 extending beyond the rearmost edge of footbrake 245.

It is to be understood that many different shapes and configurations of brake paddles 250 are contemplated. For example, rather than being generally triangular, brake paddles 250 may simply be straight, elongate high aspect ratio rectangles. Regardless of the shape of brake paddles 250, they may be made from a wide variety of materials including plastics, metals, and composites including the same composite laminated materials used to make snowboard board members, discussed above.

In an alternative configuration of wrap-around braking device 240, shown in FIG. 22, brake paddles 250 are integral with footbrake 245. For example, footbrake 245 and brake paddles 250 may be a molded flap-like member wherein brake paddles 250 extend laterally from vertical side walls of footbrake 245 and beyond the rear edge of footbrake 245. It is important to note, however, that brake paddles 250 should be attached to or formed with footbrake 245 spaced above base plate 241 when wrap-around braking device 240 is in the retracted position. The reason for this is to prevent inadvertent interaction between brake paddles 250 and the snow when the rider is simply trying to turn board member 210 (by tilting it on edge) and does not want to slow down. By placing brake paddles 250 in the upper portion of footbrake 245, and by configuring brake paddles 250 to extend beyond the rearmost edge of footbrake 245, such unintended braking is avoided. It should also be noted that an enclosure may be formed around the periphery of wrap-around braking device 240 to prevent accumulation of snow under footbrake 245. For example, a flexible rubber boot may be attached between footbrake 245 and base plate 241.

In another alternative configuration of wrap-around braking device 240, also shown in FIG. 22, footbrake 245 is integrally formed with brake paddles 250, but footbrake 245 is formed in two overlapping telescoping pieces rather than one. This overlap is seen in seam 248. For example, right half of footbrake 245A may be slightly thicker than left half 245B and have an interior slot for receiving left half 245B. Thus, left half 245B can be slid into and towards right half 245A to decrease the effective width of footbrake 245. Conversely, the two halves can be slid apart (i.e, telescoped outwardly) to increase the effective width of footbrake 245. This has the advantage of making wraparound braking device 241 adjustable in width so that it may be optimally retrofitted onto conventional snowboards of a variety of widths.

To use snowboard 200 with wrap-around braking device 240, a rider stands on board member 210 with his front foot in front binding 220 (which, as explained above, may be a conventional binding or a foot strap as hereinbefore disclosed) and rear foot just in front of wrap-around braking device 240, preferably standing on non-slip surface 230. Non-slip surface 230 is preferably an adhesive traction pad that can easily be applied to board member 210 by removing a paper backing and adhering the pad to the deck of board member 210. However, non-slip surface 230 may also be integrally formed as a part of board member 210, for example raised ridges that are embedded in board member 210.

To travel down a slope, the rider stands as described above. The rider is free to perform tricks, maneuvers and turns and can then use wrap-around braking device 240 to slow down. The rider moves his rear foot from non-slip surface 230 to footbrake 245 and exerts downward pressure on footbrake 245. This causes footbrake 245 to pivot downwardly about pivot rod 243. As brake paddles 250 are operatively connected to footbrake 245 and fixedly mounted relative thereto, brake paddles 250 also pivot downwardly about pivot rod 243. So pivoted, brake paddles 250 begin to engage with the snow underneath board member 210. More specifically, rear ends 252 of brake paddles 250 engage the snow with the most force as they are pivoted down most deeply into the snow. The drag created by the interaction of brake paddles 250 and the Snow underneath board member 210 causes snowboard 200 to decrease in speed. This decrease in speed is approximately proportional to the amount of force exerted by the rider on footbrake 245: the more force the rider exerts, the more quickly snowboard 200 will slow down.

Thus, when footbrake 245 is in a raised and undeployed position, both brake paddles 250 are completely above the bottom surface of board member 210 such that they do not interact with the snow and created drag. When footbrake 245 is in the lowered and deployed position, brake paddles 250 are partially below the bottom surface of board member 210 such that rear ends 252 of brake paddles 250 interact and engage with the snow. More specifically, since brake paddles 250 are pivoting around pivot rod 243, rear ends 252 of brake paddles 250 will be completely below the bottom surface of board member 210 when footbrake 245 is in the lowered and deployed position, although the portions of brake paddles 250 forward of rear ends 252 are not necessarily completely below the bottom surface of board member 210 when footbrake 245 is in the deployed position.

As explained above, wrap-around braking device 240 may be part of a foot brake conversion kit for retrofitting conventional snowboards, or it may be a part of a snowboard specifically designed to incorporate a footbrake. Where the snowboard is specifically designed to incorporate wrap-around braking device 240, it is to be understood that not all features of a footbrake conversion kit would necessarily have to be present. For example, in some embodiments base plate 241 could be eliminated so that footbrake 245 is mounted directly to the upper surface of board member 210. In such embodiments, pivot rod 243 may be mounted directly to the upper surface of board member 210 with footbrake 245 and brake paddles 250 pivotable thereabout.

Various modifications and alterations of the invention will become apparent to those skilled in the art without departing from the spirit and scope of the invention, which is defined by the accompanying claims. The claims should be construed with these principles in mind. All patents, publications and documents referred to herein are incorporated by reference as if set forth verbatim.

What is claimed is:

1. A snowboard, comprising:

an elongate board member having an upper surface with a riding section only in the middle of the upper surface, a bottom surface and a pair of lateral edges;

a footbrake pivotally mounted to the upper surface of the board member within the riding section only in the middle of the upper surface and on a central longitudinal axis of the board member by a pivot rod, the footbrake pivotable between a raised and undeployed position and a lowered and deployed position;

a footbrake retractor attached to the footbrake and urging the foot brake toward the raised and undeployed position; and a pair of lateral brake paddles operatively connected to the footbrake, extending beyond the lateral edges of the board member and pivotable about the pivot rod;

wherein the footbrake is forced into the lowered and deployed position by the rider actively depressing the footbrake, and wherein when the footbrake is in the raised and undeployed position, the pair of lateral brake paddles are above the bottom surface of the board member, and when the footbrake is in the lowered and deployed position, the pair of lateral brake paddles extend below the bottom surface of the board member; and wherein a handle is not attached to the board member.

2. The snowboard of claim 1, wherein the footbrake retractor is a compression spring.

3. The snowboard of claim 1, wherein the brake paddles have rear edges that extend beyond a rearmost edge of the footbrake.

4. The snowboard of claim 1, further comprising:

a base plate with a plurality of mounting apertures; and a plurality of fasteners passing through the mounting apertures and joining the base plate to the upper surface of the board member, wherein the plurality of mounting apertures are in a pattern of a conventional rear binding such that the base plate is removable and interchangeable with a conventional rear binding.

5. The snowboard of claim 1, wherein the brake paddles are elongate high aspect ratio triangular members.

6. A footbrake conversion kit for snowboards of the type having a board member without a handle and with an upper surface and a riding section only in the middle of the upper surface of the board member, the footbrake conversion kit comprising:

a base plate with a plurality of mounting apertures;

a pivot rod attached to the base plate;

a footbrake pivotable about the pivot rod and mountable on a central longitudinal axis of the board member within the riding section only in the middle of the upper surface;

a footbrake retractor attached to the base plate and to the footbrake; and a pair of lateral brake paddles operatively connected to the footbrake and pivotable about the pivot rod; and wherein the footbrake is forced into the lowered and deployed position by the rider actively depressing the footbrake.

7. The footbrake conversion kit of claim 6, wherein the base plate is mounted to a snowboard board member, the footbrake is pivotable between a raised and undeployed position and a lowered and deployed position, and wherein when the footbrake is in the raised and undeployed position, the pair of lateral brake paddles extend below the bottom surface of the board member.

8. The footbrake conversion kit of claim 6, wherein the brake paddles are elongate high aspect ratio triangular members.

* * * * *